US010043471B2

(12) United States Patent
Wang et al.

(10) Patent No.: US 10,043,471 B2
(45) Date of Patent: Aug. 7, 2018

(54) GAMMA CURVE CORRECTION METHOD FOR A LIQUID CRYSTAL DISPLAY

(71) Applicant: RICHTEK TECHNOLOGY CORPORATION, Zhubei, Hsinchu County (TW)

(72) Inventors: Der-Jiunn Wang, Zhubei (TW); Chung-Hsien Tso, Zhubei (TW); Chun-I Lin, Yangmei (TW)

(73) Assignee: Richtek Technology Corporation, Zhubei, Hsinchu County (TW)

( * ) Notice: Subject to any disclaimer, the term of this patent is extended or adjusted under 35 U.S.C. 154(b) by 0 days.

(21) Appl. No.: 14/954,513

(22) Filed: Nov. 30, 2015

(65) Prior Publication Data

US 2016/0171936 A1 Jun. 16, 2016

Related U.S. Application Data

(60) Provisional application No. 62/090,461, filed on Dec. 11, 2014.

(51) Int. Cl.
*G09G 3/36* (2006.01)

(52) U.S. Cl.
CPC ... *G09G 3/3655* (2013.01); *G09G 2320/0247* (2013.01); *G09G 2320/0673* (2013.01)

(58) Field of Classification Search
CPC ..... G09G 3/3614; G09G 3/3655
USPC ..... 345/96
See application file for complete search history.

(56) References Cited

U.S. PATENT DOCUMENTS 8,803,862 B2 8/2014 Lee
2002/0186230 A1* 12/2002 Kudo ..... G09G 3/3607 345/690
2006/0187160 A1* 8/2006 Lai ..... G09G 3/3611 345/88
2007/0164947 A1* 7/2007 Lin ..... G09G 3/3648 345/87
2008/0198122 A1* 8/2008 Shin ..... G09G 3/3648 345/94
2008/0224983 A1* 9/2008 Lee ..... G09G 3/3648 345/98
2008/0278470 A1 11/2008 Im et al.
2009/0058888 A1* 3/2009 Chou ..... G09G 3/20 345/690
2010/0171732 A1 7/2010 Miyazaki
2012/0194166 A1* 8/2012 Weng ..... G09G 3/006 324/71.1

(Continued)

FOREIGN PATENT DOCUMENTS

TW 201120857 A1 6/2011
TW 201128600 A1 8/2011
TW 201546784 A 12/2015

*Primary Examiner* — Adam J Snyder
(74) *Attorney, Agent, or Firm* — Muncy, Geissler, Olds & Lowe, P.C.

(57) ABSTRACT

A Gamma curve correction method for an LCD sets a ground potential of the LCD as a common voltage, and adjusts at least one of a plurality of positive Gamma voltages and a plurality of negative Gamma voltages of the LCD such that the central value of a Gamma curve established by the positive Gamma voltages and the negative Gamma voltages becomes closer to the common voltage. As a result, flickers existing in the images of the LCD are improved.

1 Claim, 7 Drawing Sheets

(56) References Cited

U.S. PATENT DOCUMENTS

| | | | | |
|---|---|---|---|---|
| 2013/0106925 | A1* | 5/2013 | Sasaki | G09G 3/3696 345/89 |
| 2013/0135330 | A1* | 5/2013 | Choi | G09G 3/3648 345/545 |
| 2013/0278639 | A1* | 10/2013 | Liao | G09G 3/3685 345/89 |

* cited by examiner

GAMMA CURVE CORRECTION METHOD FOR A LIQUID CRYSTAL DISPLAY

CROSS REFERENCE TO RELATED APPLICATIONS

This application claims the benefit of U.S. provisional patent application Ser. No. 62/090,461, entitled "GND Vcom Panel Gamma Curve Correction Method," filed on 11 Dec. 2014, which is incorporated herein by reference.

FIELD OF THE INVENTION

The present invention is related generally to a method for improving the flicker existing in a liquid crystal display (LCD) and, more particularly, to a Gamma curve correction method for an LCD.

BACKGROUND OF THE INVENTION

In an LCD, a Gamma curve and a common voltage Vcom influence the smooth level of the color and the image of the LCD. Since the liquid crystal molecule of the LCD can not be fixed in a voltage for too long, Gamma voltages for driving the liquid crystal molecule divide into the positive pole and negative pole. When the common voltage Vcom is at the center of the positive Gamma voltages and the negative Gamma voltages, i.e. when the common voltage Vcom equals a central value of the Gamma curve, the positive Gamma voltage and the negative Gamma voltage having the same voltage difference with the common voltage Vcom can provide the same gray scale.

FIG. 1 shows a Gamma curve 10 and a common voltage Vcom, in which the Gamma curve 10 is established by a plurality of positive Gamma voltages PV0-PV1023 and a plurality of negative Gamma voltages NV0-NV1023. The plurality of positive Gamma voltages PV0-PV1023 and the plurality of negative Gamma voltages NV0-NV1023 control the gray scales D0-D1023 of an LCD. FIG. 2 shows a circuit that controls the common voltage Vcom, in which an operation amplifier 16 generates and controls the common voltage Vcom. As shown by the waveform 12 in FIG. 1, when the common voltage Vcom is not at the central value 14 of the Gamma curve 10, flickers exist in the image of the LCD. At this time, the common voltage Vcom can be adjusted equal to the central value 14 of the Gamma curve 10 by adjusting a setting signal Vset that is provided to the operation amplifier 16 so as to improve the flicker issue of the image. However, such conventional method for adjusting the common voltage Vcom needs the extra operation amplifier 16. Moreover, the operation amplifier 16 needs a driving current, which causes extra power loss. In addition, due to the bandwidth limitation of the operation amplifier 16, the operation amplifier 16 cannot correct the common voltage Vcom immediately when the common voltage Vcom varies quickly. Further, as shown by the waveform 18 in FIG. 2, the common voltage Vcom provided by the operation amplifier 16 is not fixed but oscillating, and this will cause the flickers of the gray scales, resulting in poorer display performance.

SUMMARY OF THE INVENTION

An objective of the present invention is to provide a Gamma curve correction method for an LCD.

According to the present invention, a Gamma curve correction method for an LCD includes the steps of setting a ground potential of the LCD as a common voltage, and adjusting at least one of a plurality of positive Gamma voltages and a plurality of negative Gamma voltages used to control the gray scales of the LCD such that the central value of a Gamma curve established by the positive Gamma voltages and the negative Gamma voltages becomes closer to the common voltage.

The Gamma curve correction method according to the present invention does not need an operation amplifier to adjust the common voltage. Accordingly, the costs and the power loss can be reduced. Moreover, the ground potential of an LCD employing the Gamma curve correction method is a fixed value and thus, the common voltage does not oscillate and the gray scales don't flicker. As a result, a better display performance will be obtained.

BRIEF DESCRIPTION OF THE DRAWINGS

These and other objectives, features and advantages of the present invention will become apparent to those skilled in the art upon consideration of the following description of the preferred embodiments according to the present invention taken in conjunction with the accompanying drawings, in which.

DETAILED DESCRIPTION OF THE INVENTION

Figure 1:
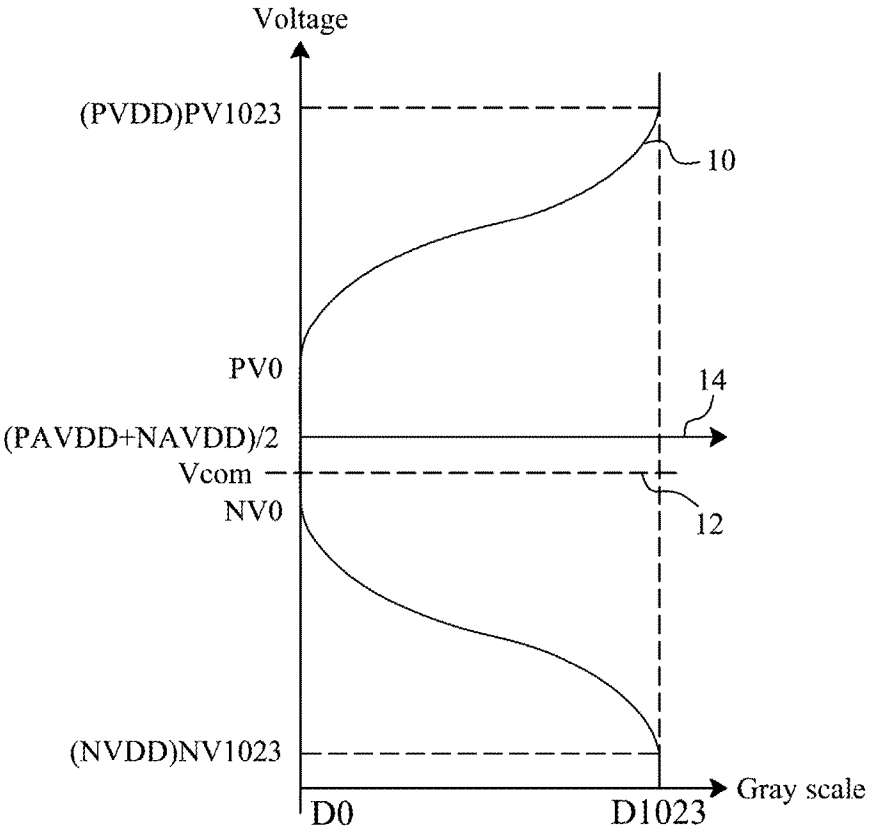
Fig. 1 Prior Art
FIG. 1 shows a Gamma curve and a common voltage Vcom.
Figure 2:
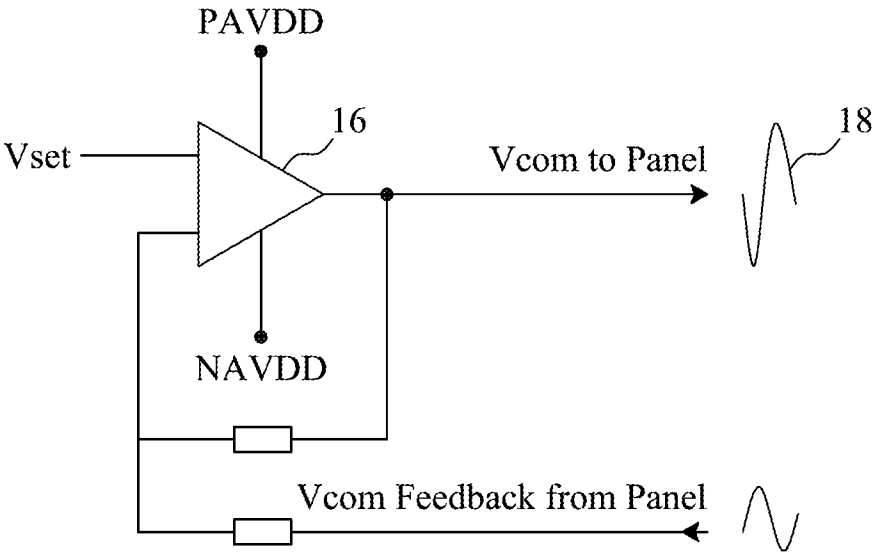
Fig. 2 Prior Art
FIG. 2 shows a circuit for controlling the common voltage Vcom.
Figure 3:
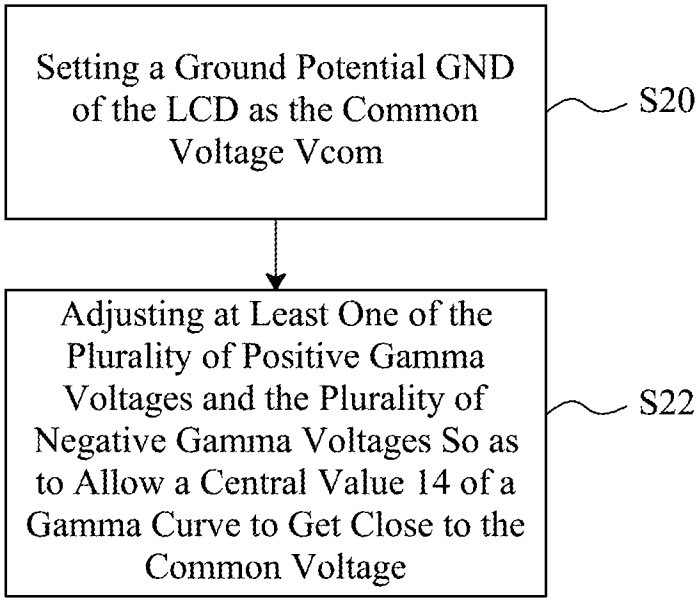
FIG. 3 is a flowchart of a Gamma curve correction method according to the present invention.
Figure 4:
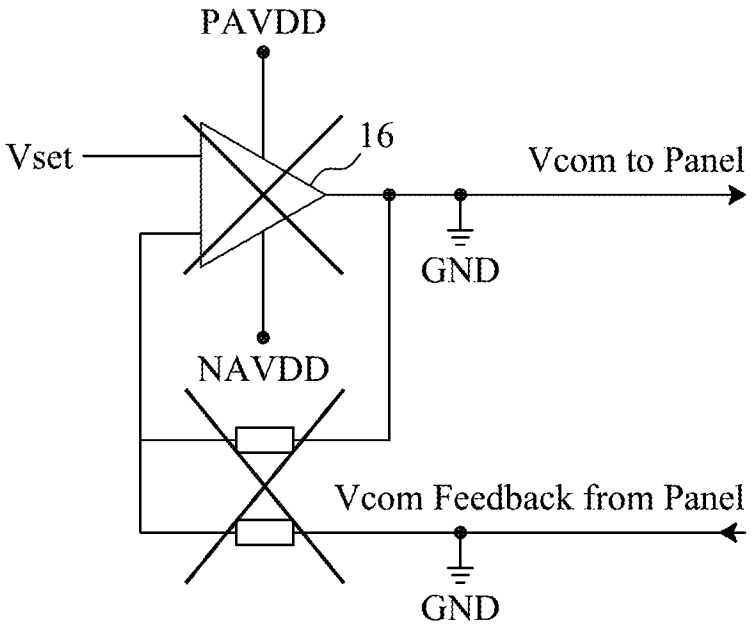
FIG. 4 is a circuit diagram applied with the Gamma curve correction method of the present invention.

Referring to FIG. 3, a flowchart of a Gamma curve correction method of the present invention is shown. Referring to FIG. 1 and FIG. 3, the Gamma curve correction method of the present invention sets a ground potential GND of an LCD as a common voltage Vcom, as shown by the step S20. Then, at least one of a plurality of positive Gamma voltages PV0-PV1023 and a plurality of negative Gamma voltages NV0-NV1023 is adjusted such that a central value 14 of a Gamma curve 10 becomes closer to the common voltage Vcom, as shown by the step S22. Accordingly, flicker issue of the image of the LCD can be improved. Preferably, the adjusted central value 14 of the Gamma curve 10 equals the common voltage Vcom. FIG. 4 shows a circuit diagram that applies the Gamma curve correction method of the present invention, in which the conventional operation amplifier 16 is removed, so that fewer costs and less power loss will be achieved. Moreover, the ground potential GND of the LCD is a fixed value, and therefore the common voltage Vcom does not oscillate to cause the flickers of the gray scales. Accordingly, a better display performance is achieved.

Figure 5:
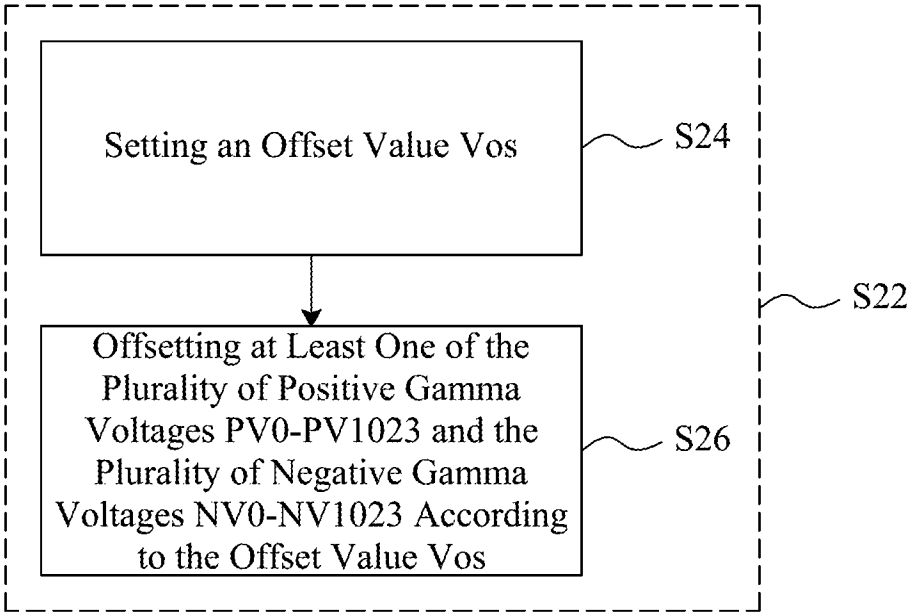
FIG. 5 is a first embodiment of the step S22 shown in FIG. 3.

FIG. 5 shows a first embodiment of the step 22 in FIG. 3, in which the step S24 includes setting an offset value Vos, and the step S26 includes offsetting at least one of the plurality of positive Gamma voltages PV0-PV1023 and the plurality of negative Gamma voltages NV0-NV1023 according to the offset value Vos so as to adjust the central value 14 of the Gamma curve 10. For example, a maximum positive Gamma voltage PV1023 or a minimum negative Gamma voltage NV1023 can be offset for adjusting the central value 14 of the Gamma curve 10. Alternatively, all of the positive Gamma voltages PV0-PV1023 and the negative Gamma voltages NV0-NV1023 can be offset in order to offset the central value 14 of the Gamma curve 10. There are known techniques that can utilize particular circuits and methods to calculate the difference value between a Gamma voltage and a common voltage Vcom. A proper offset value Vos can be set according to the difference value.

Figure 6:
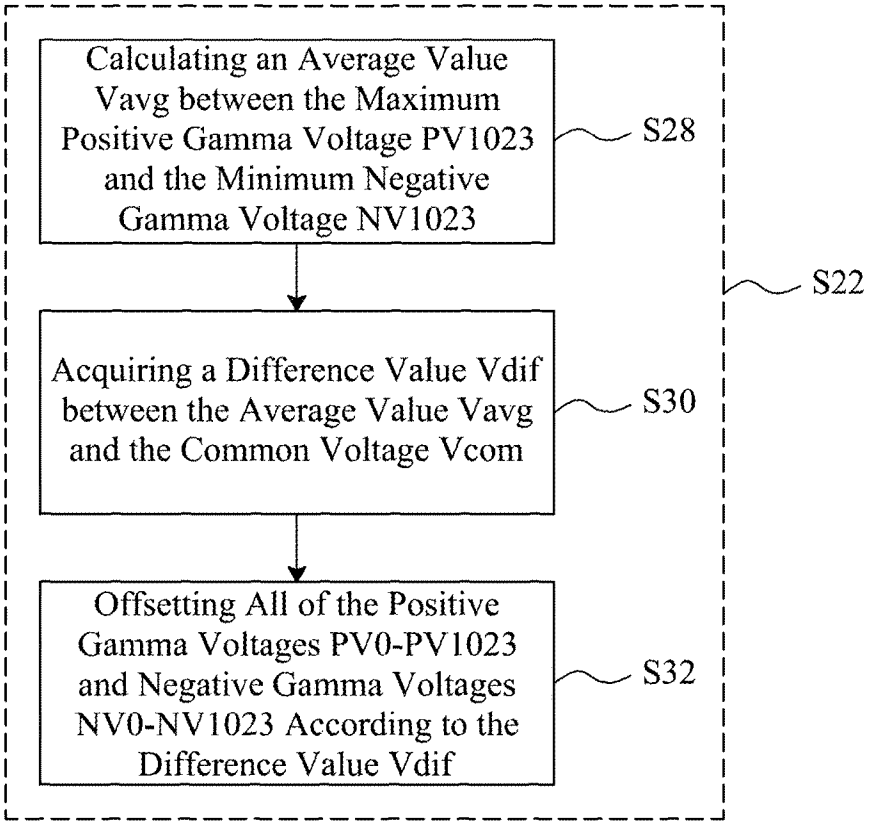
FIG. 6 is a second embodiment of the step S22 shown in FIG. 3.

FIG. 6 shows a second embodiment of the step S22 in FIG. 3, in which a step S28 includes calculating an average value Vavg between the maximum positive Gamma voltage PV1023 and the minimum negative Gamma voltage NV1023. Then, in the step S30, the difference value Vdif between the average value Vavg and the common voltage Vcom is acquired. Finally, in the step S32, all of the positive Gamma voltages PV0-PV1023 and the negative Gamma voltages NV0-NV1023 are offset according to the difference value Vdif, so that the central value 14 of the Gamma curve 10 can be offset.

In other embodiments, the offsetting can be only applied to one part of the positive Gamma voltages PV0-PV1023 and the negative Gamma voltages NV0-NV1023.

Figure 7:
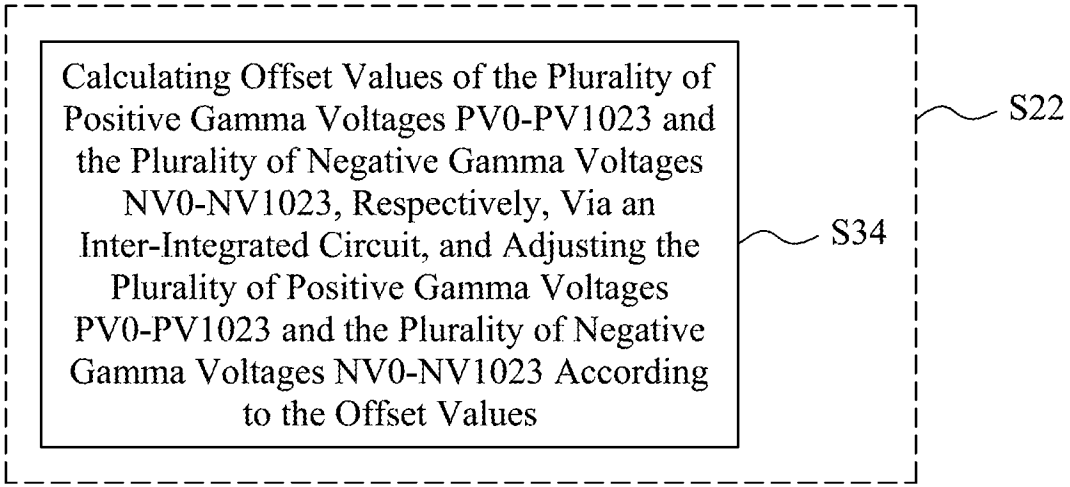
FIG. 7 is a third embodiment of the step S22 shown in FIG. 3.

FIG. 7 shows a preferred embodiment of the step S22 in FIG. 3, in which a step S34 includes utilizing an inter-integrated circuit to calculate the offset values of the positive Gamma voltages PV0-PV1023 and the negative Gamma voltages NV0-NV1023, respectively, and adjusting the positive Gamma voltages PV0-PV1023 and the negative Gamma voltages NV0-NV1023 according to the offset values. There are known techniques that can utilize the built-in inter-integrated circuit to calculate the difference value between every Gamma voltage and a common voltage. Namely, a proper offset value can be set according to each Gamma voltage. In other embodiments, the offsetting can be only applied to one part of the positive Gamma voltages PV0-PV1023 and the negative Gamma voltages NV0-NV1023.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A Gamma curve correction method for a liquid crystal display having a plurality of positive Gamma voltages and a plurality of negative Gamma voltages to control a gray scale of the liquid crystal display, the Gamma curve correction method comprising the steps of:

a.) setting a ground potential of the liquid crystal display as a common voltage; and b.) adjusting at least one of the plurality of positive Gamma voltages and the plurality of negative Gamma voltages such that a central value of a Gamma curve established by the plurality of positive Gamma voltages and the plurality of negative Gamma voltages becomes closer to the common voltage;

wherein the step b comprises the steps of:

calculating an average value between a maximum value of the plurality of positive Gamma voltages and a minimum value of the plurality of negative Gamma voltages;

acquiring a difference value between the average value and the common voltage; and offsetting the plurality of positive Gamma voltages and the plurality of negative Gamma voltages according to the difference value.

* * * * *